US006422478B1

(12) United States Patent
Lucas, Jr.

(10) Patent No.: US 6,422,478 B1
(45) Date of Patent: Jul. 23, 2002

(54) RAILROAD TIE PAD FOR CROSSINGS

(75) Inventor: Joseph Lucas, Jr., Beaverton, OR (US)

(73) Assignee: Northwest Rubber Extruders, Inc., Beaverton, OR (US)

( * ) Notice: Subject to any disclaimer, the term of this patent is extended or adjusted under 35 U.S.C. 154(b) by 0 days.

(21) Appl. No.: 09/877,821

(22) Filed: Jun. 7, 2001

(51) Int. Cl.[7] ..... E01B 1/00
(52) U.S. Cl. ..... 238/8; 238/2
(58) Field of Search ..... 238/2, 8, 9

(56) References Cited

U.S. PATENT DOCUMENTS

| | | | | | |
|---|---|---|---|---|---|
| 4,267,969 | A | * | 5/1981 | Hales et al. | 238/8 |
| 5,181,657 | A | * | 1/1993 | Davis | 238/8 |
| 5,513,797 | A | * | 5/1996 | Lesley | 238/9 |
| 6,250,562 | B1 | * | 6/2001 | Bruyn | 238/8 |

FOREIGN PATENT DOCUMENTS

CA 2281110 8/1998

OTHER PUBLICATIONS

"Cushioning the Blows," Mechanical Engineer (May 2000) pp. 72–73.
Performance Polymers, product information sheet and drawings, (Jan. 2000).
CXI Prestressed Concrete Systems Crossings, product information brochure (date unknown).

* cited by examiner

*Primary Examiner*—J. Joseph Morano
*Assistant Examiner*—Lois A. Olson
(74) *Attorney, Agent, or Firm*—Chernoff, Vilhauer, McClung & Stenzel

(57) ABSTRACT

Elastomeric pads positioned on top of railroad ties have flanges that extend along chamfered corners of railroad ties and shoulders that extend upward and are located along the tops of the flanges. Pre-cast concrete panels that are commonly provided at railway grade crossings between and alongside the rails rest on the pads. The shoulders are compressible by the weight of the concrete panels and help to keep the flanges in place on the chamfered edges of the ties and resist movement of the pads from their intended positions between the concrete panels and the ties. The pads may be extruded of thermoplastic synthetic rubber.

23 Claims, 3 Drawing Sheets

RAILROAD TIE PAD FOR CROSSINGS

BACKGROUND OF THE INVENTION

The present invention relates to construction of railway grade crossings where railroads intersect vehicular roads, and in particular to such grade crossings where a portion of the vehicular roadway includes concrete panels that are supported atop the railroad ties of the railroad track.

At railway grade crossings cast concrete "filler" panels or slabs are used to fill the spaces between the rails and along the outer side of each rail to provide a roadway surface. Such concrete panels rest on top of the railroad ties, with each panel covering several ties and having its top surface aligned with the roadway surface to establish a smooth crossing for vehicles. Despite having been engineered to withstand the weight of vehicular traffic, these panels are subject to wear and can fail prematurely.

The concrete filler panels used in grade crossings are typically not loaded other than by their own weight. When a heavy truck passes over the crossing, the panels are subjected to bending stresses, tending to deflect downward where the tires of vehicles pass over areas of the panels that are not directly supported by the ties. If the tops of the ties are not even with each other, a panel might bridge the distance between several ties without actually contacting the tops of intermediate ties. If a panel is flexible enough, under a heavy road-traffic load it might deflect so that the undersurface of the panel is brought into contact with the tops of low-standing intermediate ties. Once the panel touches the top of a low-standing tie, it is then supported by that tie and does not deflect further. In some cases, it is not the bending stress sustained by the entire panel that causes the panel to fail. Rather, it is the fact that the undersurface of the panel is in tension as it repeatedly strikes against the upper surface of the tie so that tiny chips are broken away from the bottom surface of the panel, leading to eventual surface cracks and propagation of the cracks. Premature failure of a panel in such railway crossings is most likely to occur when the ties are unusually uneven. Although the tops of all the ties should be at the same height at the rail-attachment point, the top surfaces of the ties are often not at exactly the same heights except at the rail-attachment points. Also, some ties have manufacturers' logos or other writing in raised relief on their top surfaces. Concrete panels and concrete ties both have metal reinforcing bars included within the concrete, and these reinforcing bars can cause slight distortion of the surfaces of the concrete components. Further, due to the relatively large size of the panels, the underside surfaces of the panels may not be completely flat.

Variation in ties and concrete filler panels is taken into account when the panels are designed, and the amount of bending stress the panel might experience should not ordinarily cause the panel to fail. However, the panels still do fail, and in order to counter premature failure of the concrete panels, pads of rubber or rubberlike materials have been used atop the ties to distribute the loads of motor vehicle traffic more evenly. The presence of rubber tie pads between the ties and the panels distributes the forces caused by projecting irregularities on the tops of the ties, helps compensate for uneven ties, reduces the pressure applied to the bottom surfaces of the panel when it is in tension and protects the panel from repeated impact on the ties. Such a pad is disclosed in published Canadian patent application No. 2,281,110, and an article in the May 2000 issue of *Mechanical Engineering*.

While pads may improve the longevity of the concrete panels, vibration caused by a train passing along the tracks at a grade crossing can cause the pads to migrate from their optimal position between the ties and the concrete filler panels, walking themselves out of position.

The pad disclosed in the Canadian application identified above includes end flaps to discourage movement of the tie pads. The pad disclosed in the *Mechanical Engineering* article uses a hollow cell to address this problem. Applicant believes that there are disadvantages to both these designs and has invented an improved tie pad.

BRIEF DESCRIPTION OF THE INVENTION

The present invention provides an improved tie pad that resists movement with respect to its supporting tie. A tie pad according to the present invention has flanges that extend downwardly from the side margins of a main panel of the pad and upwardly projecting shoulders near the interconnection of the main panel with the flanges. The upwardly projecting shoulders provide frictional contact against the bottom surfaces of the concrete filler panels, and when pressed downward by the concrete filler panel, the shoulders push the flanges against the edges or sides of the tie, causing the pad to engage and grip the tie and preventing the pad from migrating from its proper position atop the tie.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
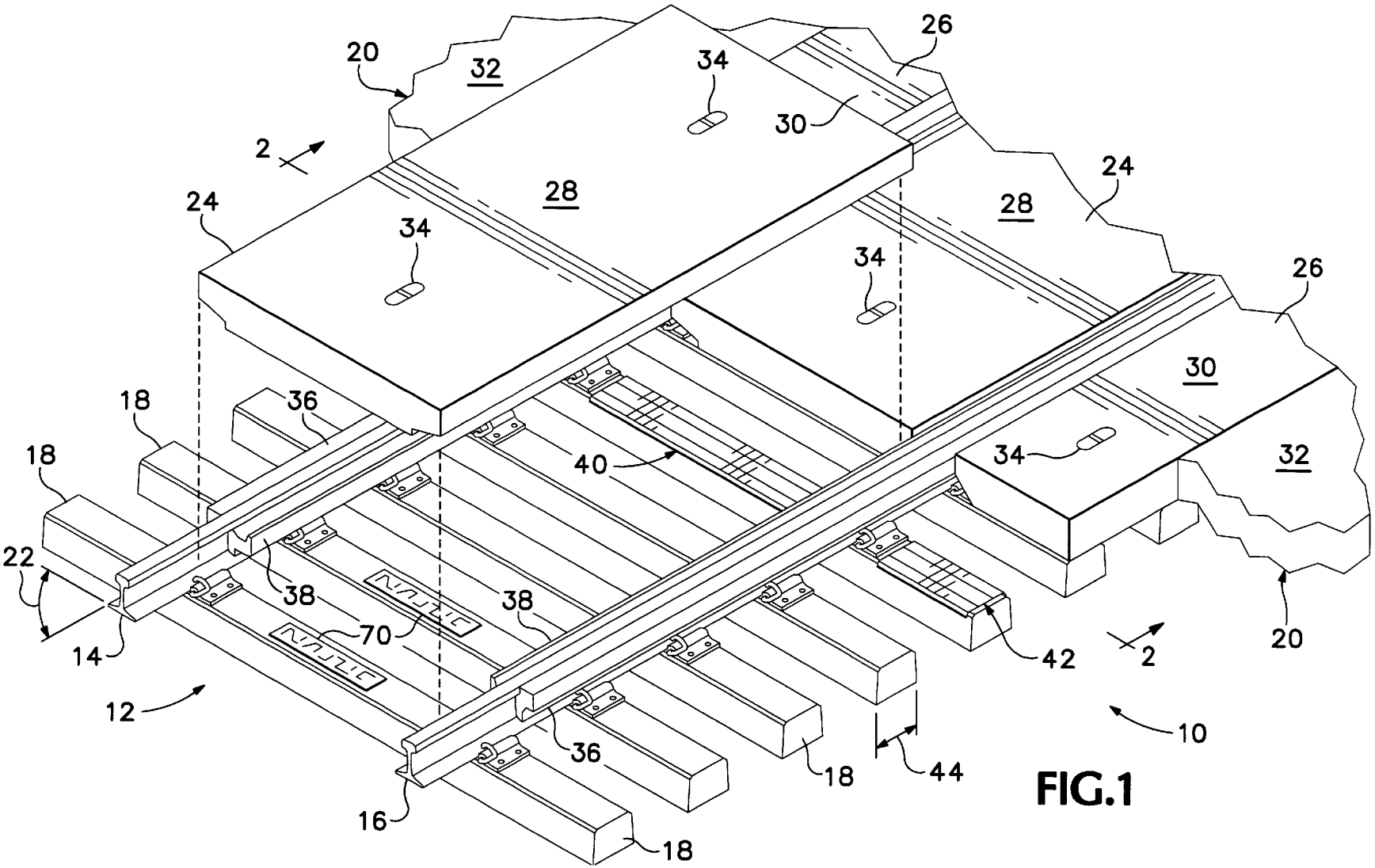
FIG. 1 is a diagrammatic view showing the use of concrete filler panels at a railway grade crossing, and showing the placement of elastomeric tie pads according to the present intention between the ties and the concrete filler panels.

Referring now to the drawings which form a part of the disclosure herein, a railway grade crossing 10 shown in FIG. 1 includes a railroad track 12 having parallel rails 14, 16 supported on cross ties 18, which are typically set into ballast (not shown). The ties 18 are preferably of concrete, as it permits economical manufacture with well-defined shapes and of relatively accurate dimensions but could be of wood or other material. A road 20 for vehicular traffic is shown crossing the railway track 12 at an angle 22 of approximately 90° but the road could also cross at a significantly different angle. Concrete filler panels 24 and 26 have respective upper surfaces 28 and 30 located at substantially the same height as the upper surface 32 of the road 20 on either side of the crossing 10. In the particular grade crossing 10 shown in FIG. 1 the road 20 is sufficiently wide such that two wide panels 24 arranged end-to-end are needed between the rails 14 and 16. Similarly, on each side of the track 12 two smaller side panels 26 have been placed end-to-end outside the rails 14 and 16 with their upper surfaces 30 aligned with the road surface 32 of the road 20. The wide panels 24 are known as gauge panels, and the narrower panels 26 are known as field panels. In constructing the grade crossing 10 the concrete filler panels 24 and 26 are lowered into place with a suitable hoist, using hook eyes 34 which are provided in the panels for that purpose. Elastomeric rail boot or seal strips 36 and 38 are installed between the panels 24, 26, and the rails 14, 16, as shown also in FIG. 2.

Figure 2:
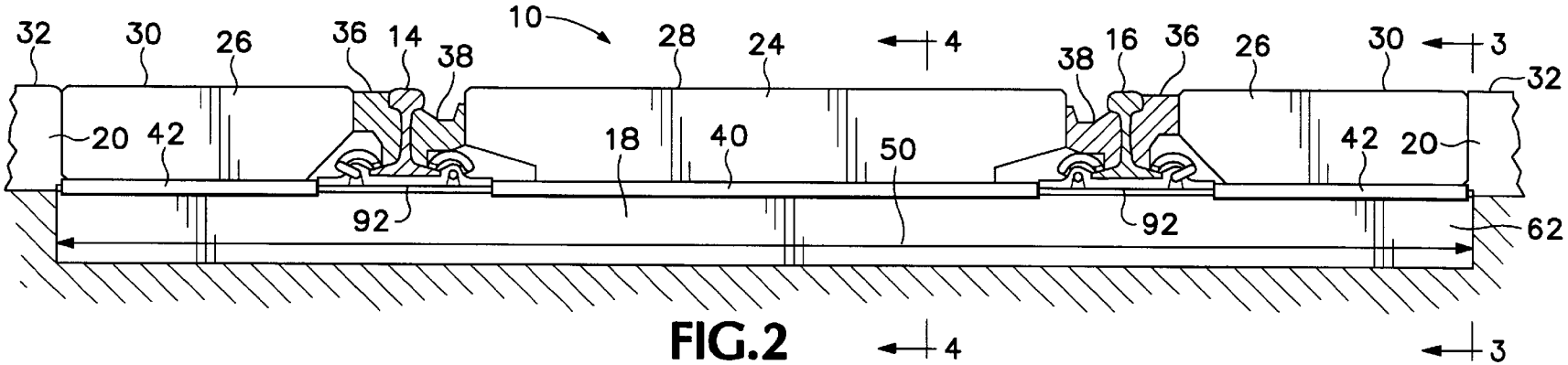
FIG. 2 is a sectional view of the railway grade crossing shown in FIG. 1, taken in the direction of line 2—2 in FIG. 1.
Figure 3:
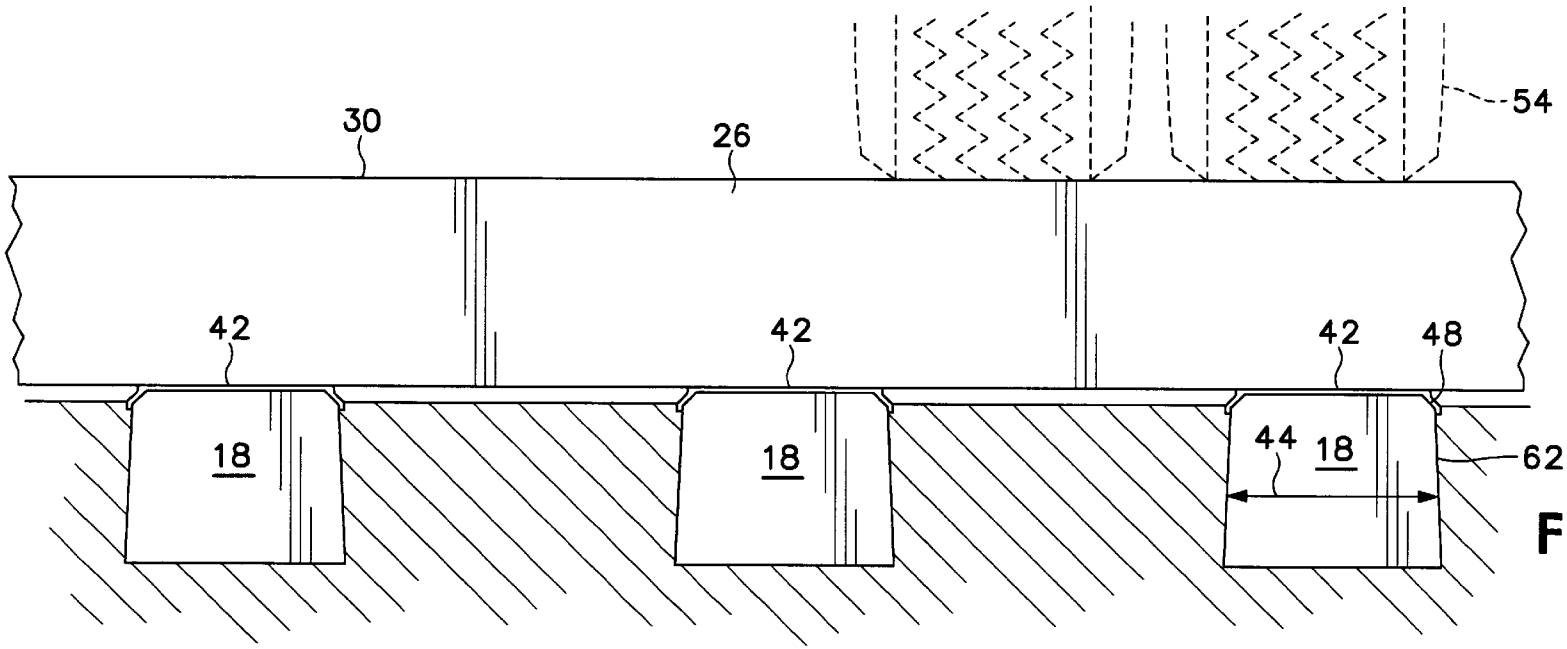
FIG. 3 is a sectional view of the railway grade crossing shown in FIG. 1, taken in the direction of line 3—3 in FIG. 2.

Tie pads 40, 42 similar to each other except for their lengths, are located directly on the tops of the ties 18 as may also be seen in FIGS. 2 and 3. The gauge panels 24 rest on top of the gauge pads 40 and the field panels 26 rest on top of the field pads 42.

The tie pads 40 and 42 must be correctly located and kept in place on top of the ties 18 so it is important that the pads resist movement once they are installed. The panels 24 and 26 could be especially liable to premature failure should the pads 40, 42 be displaced from their proper positions between the ties 18 and the panels. While tie pads 40 and 42 may be secured to the ties 18, or to the underside of the panels 24 and 26 by adhesive, preferably the tie pads are held in position on the ties by the relationships between the respective shapes of the tie pads and the ties.

As shown in FIG. 3, each tie pad 40, 42 is held in position on the width 44 of each tie 18 by flanges 46 that rest on a diagonal surface 48 of the chamfered upper longitudinal edges of the ties 18.

The pads 40, 42 also need to be held in the proper positions along the length 50 of the ties 18. This may be done in a number of ways. For example, in FIG. 2, the pad 40 is restrained from longitudinal movement along the length 50 of tie 18 by abutting against the rail attachment hardware 92. Alternatively, shoulders on the tie 18, attachment to the panels 24 and 26 or abutment against adjoining structure such as ballast or the roadway 20 may be used.

As shown in FIG. 3, the pads 40 and 42 support the filler panels 24 and 26 atop the ties 18, preventing direct contact between the tops of the ties and the undersides of the panels. When the bottom surface of panel 24 or 26 is loaded in tension by the weight of a vehicle 54 on the upper surface 28 or 30 of one of the filler panels, surface irregularities such as bumps on the top surface of the ties 18 do not press directly against the bottom surface of the panels, and the forces resulting from such irregularities are spread over a larger area by the elastic deformation of the tie pads 40 and 42 at such points.

Figure 4:
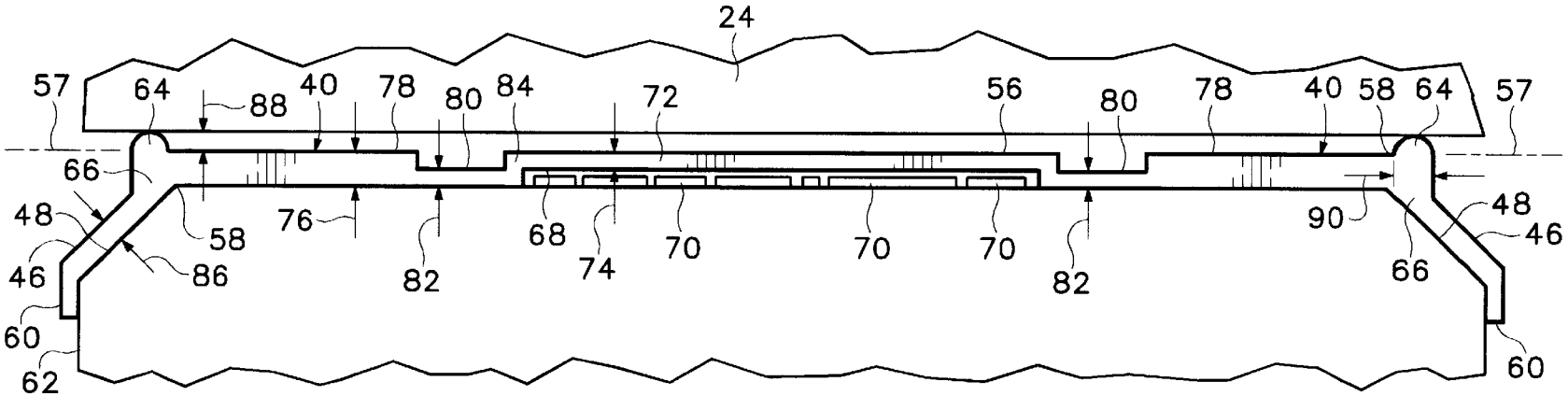
FIG. 4 is a sectional detail view, taken in the direction of line 4—4 in FIG. 2, showing the profile of an extruded elastomeric tie pad such as those shown in FIG. 1, in position on top of a relatively low-standing tie in a railway grade crossing such as that shown in FIG. 1.

In FIG. 4, the profile of one embodiment of a tie pad is shown in a relaxed condition, with a gauge pad 40 atop the central portion of a tie 18. A gauge panel 24 is located above the tie pad 40 and the tie 18. The tie shown in FIG. 4 is relatively low-standing in comparison with other ties (not shown) on either side of it. As a result, the panel 24 barely rests on tie pad 40.

Figure 5:
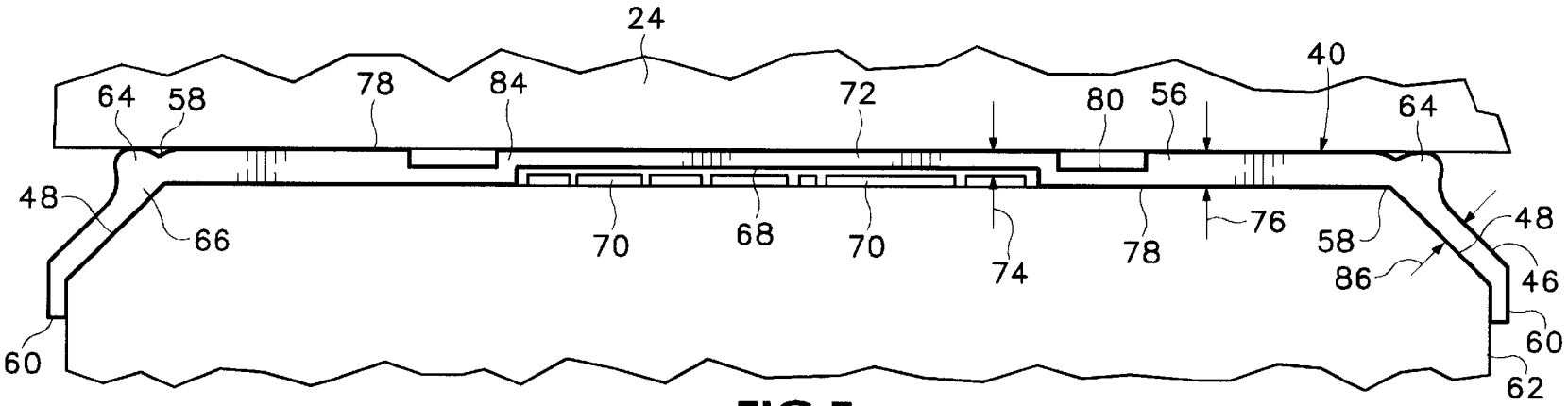
FIG. 5 is a view similar to that of FIG. 4, except that the elastomeric tie pad is shown compressed by the concrete filler panel.

Referring to FIGS. 4 and 5, tie pad 40 includes a main panel 56 extending horizontally along the top of the tie 18. A pair of flanges 46 located along the side margins 58 of the main panel 56, extend diagonally downward along the surfaces 48 of the chamfered longitudinal edges of the tie 18. An outer, or lower, margin portion 60 of each flange 46 extends downwardly along the vertical side 62 of the tie 18. Raised shoulders 64 project upwardly above a plane 57 defined generally by the top surface of the main panel 56 and are located proximate the side margins 58 of the main panel and the inner, or upper margin 66 of the flange. In the exemplary embodiment the shoulders extend longitudinally along the entire length of the tie pad 40 or 42 but this need not be so. The shoulders 64 in the exemplary embodiment are located wholly over the flanges 46, outboard of the side margins 58 of the main panel 56, but shoulders that are not wholly over the flanges could achieve the intended results.

In the exemplary embodiment, a bottom cavity 68 is defined in the bottom face of the main panel 56 of the tie pad 40 to provide clearance for a logo or lettering 70 often found in raised relief on the top of a molded concrete tie 18. The central portion 72 of the main panel 56 above the bottom cavity 68 thus has a thickness 74 less than the thickness 76 of the two lateral portions 78 of the main panel.

The embodiment shown in FIGS. 4 and 5 has a pair of grooves 80 in the top face of the main panel 56 laterally outward on each side from the location of the bottom cavity 68, resulting in a strip of material whose thickness 82, is also less than the thickness 76 of the lateral portions 78 of the main panel 56. The top grooves may be used to receive adhesive, and also contribute to the flexibility of the tie pad 40. The top grooves 80 and the bottom cavity 68 result in a jog portion 84. Although the jog portion 84 is shown as perpendicular to the general plane of the main panel 56, the jog portion may form other angles with the general plane of the main panel.

The tie pads 40 and 42 are preferably formed by extruding suitable thermoplastic elastomeric material from the same tool or die. A suitable material for the tie pads 40 and 42 is a rubber or rubberlike material with an ability to withstand weather conditions and to remain elastic throughout the expected range of temperatures in the environment of the grade crossing 10. A suitable material would preferably have a hardness in the range of 25 to 80 Shore A Durometer. One acceptable material is an extrudable thermoplastic synthetic rubber material called SANTOPRENE™with a hardness of 65A, a combination of highly crosslinked rubber particles in a continuous matrix of thermoplastic material, available from Advanced Elastomer Systems, L. P., of Akron, Ohio, In the exemplary embodiment, the thick lateral portions 78 of the main panel 56 preferably have a thickness 76 of about 0.250 inch, while the thicknesses 74 and 82 of the material in the central portion of the main panel 56 may be 0.125 inch. The thickness 86 of the diagonal portions of the flanges 46 is preferably about 0.020 inch, while the outer or lower margin portions 60 of the flanges 56 may have a thickness of 0.125.

The shoulders 64 are preferably located above the upper, or inner, margin portions 66 of the flanges 46. In the exemplary embodiment, the shoulders 64 have a height 88, above the main panel 56 of the tie pads, of 0.125 inch when uncompressed, for example, and preferably within the range of 0.100–0.150 inch. Each shoulder 64 has a relaxed width 90 of 0.250 inch, for example. The rounded upper surface of each shoulder 64 makes it progressively more difficult to compress the shoulder as clearance between the top of the tie 18 and the underside of the filler panel 24 or 26 is reduced. The weight of the panels 24 and 26, on the shoulders 64, causes the flange 46 to press downwardly against the diagonal surface 48 of the tie 18. This tends to keep the pads 40, 42 in place since the flanges would have to move upwardly in order to permit the pads to move laterally. Further, since the shoulders 64 are located outwardly of the side margins 58 of the main panel 56, the flange tends to pivot downwardly and inwardly at the side margin 58. Thus, the flanges 46 on both margins of the tie pads 40 and 42, engage both longitudinal edges of the tie 18, preventing lateral movement of the tie pad with respect to the tie if in response to movement of the track 12 as vehicles move over the panels 24 and 26 as a train moves through the grade crossing 10. Contact between the shoulders 64 and the underside surface of the panels 24 or 26 also frictionally resists movement of the pads 40 and 42, longitudinally and laterally with respect to the tie 18.

The top grooves 80 and the bottom cavity 68 leave the central portion 72 of the main panel 56 adapted to accommodate slight differences in width of the tie 18 by flexure of the material in the jog portions 84.

As shown in FIG. 5, when a concrete filler panel 24 or 26 is supported by a tie pad 40 or 42 located on top of a higher-standing tie 18, or when the weight of a vehicle on the top of the panel 24 or 26 deflects a panel 24 or 26 downwardly toward a tie pad 40 or 42 atop relatively low-standing tie 18, the shoulders 64 are compressed by the panel 24 or 26 and are urged down and bulge outward along the diagonal surface 48 of the chamfered upper edges of the tie 18, urging the flanges 46 downward with respect to the main panel 56 of the pad 40 or 42.

The weight of the concrete filler panels 24 or 26 and vehicles carried atop the panels also tends to compress the thick lateral portions 78 of the main panel 56 of the tie pod, causing the material of the lateral portions 78 to bulge toward the shoulders 64 and the central portion 72 of the main panel, as shown in FIG. 5. The top grooves 80 and the bottom cavity 68 provide space into which the squeezed elastic material can bulge. With the elastomeric tie pads 40 and 42 thus squeezed between the concrete panels 24 and 26 and the tie 18, the resistance to further compression of the elastomeric pad material is great enough so that the weight of vehicles on the panels 24 and 26 is efficiently transferred to the ties 18.

The elastomeric pads 40, 42 also act to protect the concrete filler panels 24, 26 by effectively enlarging the area of contact, between the top of a tie 18 and the underside of a concrete filler panel. 24 or 16 where a bump or other surface irregularity is present. This is particularly valuable when the bottom of a concrete panel 24 or 26 is in tension, as when a vehicle is pressing down on its upper side surface 28 or 30 between two relatively high ties 18. The tie pads 40, 42 thus help to reduce the likelihood of fretting, development of surface cracks and propagation of cracks in the bottom surfaces of the concrete filler panels 24, 26, making the panels less likely to fail prematurely.

So long as the pads cover the ties 18 sufficiently to achieve the results discussed above, the tie pads 40, 42 can be shorter than the ties. Although the exemplary tie pads 40 and 42 are shown for use with a flat tie with a chamfered edge, the invention may be used with ties with other shapes. While the flange 46 in the exemplary embodiment is shown extending along the entire length of the tie 18, this arrangement may not be necessary to prevent lateral movement of the pads 40 and 42 with respect to the tie.

While the invention has been described with respect to a railroad crossing at a roadway, it would be applicable in any situation where a dynamic load bearing surface is supported by spaced apart ties or similar supporting structure.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A tie pad of elastomeric material for use atop an elongate tie of a track having rails supported by a plurality of said ties, the tie pad comprising:

(a) a main panel locatable on said tie and having a length, width, and a first side margin extending longitudinally along said main panel, the top surface of said main panel generally defining a plane;

(b) a first flange, adjacent said first side margin of said main panel and engagable with said tie, said first flange having an inner margin connected to said first side margin of said main panel; and (c) a first shoulder projectable above said plane and located proximate said interconnection of said first side margin of said main panel and said inner margin of said first flange, said first shoulder extending longitudinally for at least a portion of said main panel.

2. The tie pad of claim 1, wherein said flange is extendable downwardly from said main panel.

3. The tie pad of claim 1 wherein said shoulder is positioned such that a substantially downward force on said shoulder causes said flange to engage said tie.

4. The tie pad of claim 1, wherein said first flange is extendable downwardly, said first shoulder located with respect to said first flange such that substantially downward force on said first shoulder urges said first flange downwardly.

5. The tie pad of claim 1 wherein said first flange is extendable downwardly, said first shoulder located with respect to said first flange such that substantially downward force on said shoulder discourages upward movement of said flange.

6. The tie pad of claim 1 wherein said first flange is extendable downwardly and inwardly, said first shoulder located with respect to said first flange such that substantially downward force on said shoulder urges said flange inwardly.

7. The tie pad of claim 1 wherein said first shoulder extends longitudinally along said first flange closely proximate said first side margin of said main panel.

8. The tie pad of claim 1 wherein said first shoulder is located at least partially above said first flange outboard of said first side margin of said main panel.

9. The tie pad of claim 1 wherein said first shoulder is located above said first flange outboard of said first side margin of said main panel.

10. The tie pad of claim 1 wherein said shoulder is narrower at the top than at the bottom.

11. The tie pad of claim 1 wherein said main panel defines a thin central portion and a pair of relatively thick lateral portions.

12. The tie pad of claim 11 wherein said main panel defines a top groove and includes a jog portion interconnecting said thin central portion with said top groove.

13. The tie pad of claim 1 wherein said main panel defines a cavity in a bottom side thereof, said cavity capable of receiving a raised logo portion of said concrete tie when said tie pad is in place atop said concrete tie.

14. The tie pad of claim 1, including a second side margin and a second flange.

15. The tie pad of claim 14, further including a second shoulder.

16. The tie pad of claim 1, further including a second flange engagable with said tie.

17. The tie pad of claim 1 wherein said elastomeric material has a hardness in the range from 25 to 80 on the Shore A Durometer scale.

18. The tie pad of claim 1 wherein said main panel includes a bottom surface and a top surface, said surfaces defining a jog in the material of the tie pad.

19. The tie pad of claim 18 wherein said jog is configurable so as to enable a change in said width of said main panel.

20. A method of locating a tie pad laterally with respect to an elongate tie having a longitudinally extending top and side comprising the steps of:

(a) providing a tie pad having a main panel locatable on said top of said tie;

(b) providing said tie pad with a flange adjacent said main panel and engagable with said side of said tie;

(c) providing said tie pad with a shoulder proximate said flange and projectable above a plane defined generally by the top surface of said main panel; and (d) providing a substantially downward force on said shoulder urging said flange into engagement with said side of said tie.

21. The method of claim 20 wherein such downward force on said shoulder resists upward movement of said flange.

22. The method of claim 20, further including locating said shoulder at least partially above said flange.

23. The method of claim 20, further including locating said shoulder above said flange.

* * * * *